United States Patent [19]

Sanvito

[11] 4,135,464

[45] Jan. 23, 1979

[54] SEWING UNIT FOR JOINING SUPERIMPOSED LENGTHS OF CLOTH

[75] Inventor: Robert Sanvito, Milan, Italy

[73] Assignee: Rockwell-Rimoldi S.p.A., Milan, Italy

[21] Appl. No.: 872,974

[22] Filed: Jan. 27, 1978

[30] Foreign Application Priority Data

Feb. 4, 1977 [IT] Italy ..... 19962 A/77

[51] Int. Cl.[2] ..... D05B 21/00

[52] U.S. Cl. ..... 112/121.15; 112/121.26; 112/136; 112/153

[58] Field of Search ..... 112/121.15, 121.26, 112/121.27, 136, 141, 153, 152, 143

[56] References Cited

U.S. PATENT DOCUMENTS

| | | | |
|---|---|---|---|
| 2,761,401 | 9/1956 | Dolney | 112/121.26 X |
| 3,664,284 | 5/1972 | Hester | 112/152 |
| 4,062,309 | 12/1977 | Pollmeier et al. | 112/121.26 X |
| 4,066,027 | 1/1978 | Marforio | 112/121.26 X |
| 4,080,912 | 3/1978 | Marforio | 112/121.15 |

FOREIGN PATENT DOCUMENTS 2554022 6/1977 Fed. Rep. of Germany ..... 112/121.26

*Primary Examiner*—H. Hampton Hunter

[57] ABSTRACT

A guiding apparatus in a sewing unit for seaming superimposed layers of cloth having intersecting seams defining areas of increased thickness. The apparatus includes a pair of spaced channel type guides within which the layers of cloth are guided during their advance to the stitch forming instrumentalities. The areas of increased thickness are disposed intermediate the two guides which are both movable to and from positions of close proximity with the stitch forming area. As the guide most remote from the machine's needle approaches the latter the guide adjacent the needle is timed to be withdrawn to an inoperative position permitting the approaching guide to assume the withdrawn guide's operating position thereby permitting the areas of increased thickness to be presented to the stitching instrumentalities without passing through the channels of either of the guides.

4 Claims, 4 Drawing Figures

SEWING UNIT FOR JOINING SUPERIMPOSED LENGTHS OF CLOTH

BACKGROUND OF THE INVENTION

The present invention pertains to a sewing unit for automatically joining lengths of cloth, of the type that includes a conventional sewing machine having the usual needle and feed mechanism that defines the sewing axis along which said lengths of cloth are fed in order to be joined.

The known forms of sewing units are usually equipped with a guide that consists of superimposed blades that are disposed in spaced relation so as to define channels between which the lengths of cloth to be joined are positioned and slidable.

These sewing units also have auxiliary devices that travel with the cloth, such as an end and an intermediate gripper, which serve to keep the superimposed edges to be sewn aligned and taut.

The spaces between the blades defining the guide channels are slightly greater than the thickness of the cloth, so as to prevent the cloth from bunching in said channels during the sewing operation.

One drawback of using such guides is that they obstruct the free sliding movement of the cloth when there are intersecting seams in the workpiece or thicker areas due to the application of pockets or the like.

The problem is particularly acute with regard to the sewing of trouser-leg seams when the crotch seam, which intersects the inside seam, is located forwardly of the guide.

More specifically, the problem is more pronounced when the fabric is of lightweight construction and very pliable. To provide the sewing unit with guides having adequate channels to permit passage of the intersecting seams results in an excessive freedom of movement of the cloth causing the latter to fold on itself and the intended aligning action of the guides on the superimposed edges is lost.

The same problem arises, for example, when knitted garments or tops with sleeves are to be joined with the sleeve-joint seam during the closing of the sleeve or the relevant side which procedure is normally performed in one continuous operation.

This problem has already been resolved in those cases where the seam that intersects the joining seam or the thicker areas is very close to the point where the joining seam begins as, for example, in the case of the joining of trouser quarters with a pocket (already attached).

The solution for such cases provides a movable work guide, located adjacent the sewing machine, that is attached to the lengths of cloth to be joined, after said intersecting seams or thicker areas have been sewn.

The guiding action on these lengths of cloth for the short distance involved with regard to intersecting seams or thicker areas is carried out directly by the presser foot of the sewing machine in conjunction with the guide itself, which is mounted on a suitable rectilinear rail. Advantage was taken of the fact that the edges in such a position fit together and have identical profiles. On the other hand, in the event that the intersecting seams or the thicker areas are substantially spaced from the starting point of the joining seam — as is the case of trouser crotch seams or the sleeve-joints of knitted garments — it is not possible to utilize available technology.

An object of the present invention is to facilitate sewing operations of the type described above by means of the use of guides having channels which are proportioned according to the thickness of the lengths of cloth, without having to take into account the areas of greater thickness formed therein. This object is completely accomplished by the automatic unit comprising the present invention.

SUMMARY OF THE INVENTION

This unit includes a conventional sewing machine equipped with the usual needle and feed mechanism that defines the sewing axis along which the lengths of cloth are advanced for the purpose of being joined, and auxiliary intermediate and end devices that travel with said lengths of cloth and maintain them under a preferred amount of tension. The unit is characterized by the fact that it is provided with both a slidably mounted guide that travels perpendicular to the sewing axis and a movable companion guide that travels parallel with the sewing axis. The slidably mounted guide is movable from an operating position adjacent to the needle to a rest position spaced from said needle. The movable companion guide travels from an initial position remote from the needle to a work position adjacent to said needle and is adapted to move along with the lengths of cloth and hold them taut when said slidably mounted guide is in its operating position. The companion guide is adapted to take over the task of guiding the lengths of cloth from the slidably mounted guide when said slidably mounted guide is moved to its rest position upon activation of sensing devices by said movable companion guide. The substitution of the movable companion guide for the slidably mounted guide is effective in causing the automatic sewing of a seam on lengths of cloth, initially positioned between said guides, which include intersecting seams or thick areas.

These and other features of the invention will become more fully apparent by reference to the appended claims and as the following detailed description proceeds in reference to the figures of drawings wherein:

DESCRIPTION OF THE PREFERRED EMBODIMENT

Figure 1:
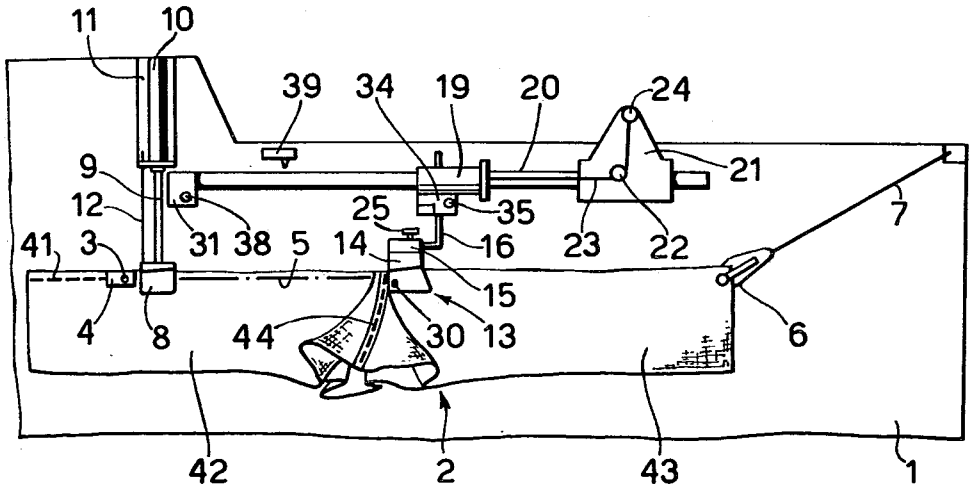
FIG. 1 is a top view of a sewing unit showing the guides according to the invention applied thereto.

With regard to FIG. 1, the sewing unit includes a work surface 1 for the workpiece 2 and has a sewing machine mounted thereon and to show other details of the invention more clearly, is defined only by its needle 3 and the feed mechanism 4 which defines the sewing axis 5 along which the lengths of cloth to be sewn are advanced in order to be joined. The work surface 1 includes a known type of travelling gripper 6 that is attached to the workpiece and is drawn by the latter in the opposite direction from the pull of a cable 7 to which is attached a counterweight (not shown).

Forwardly of the sewing area as defined by the needle 3 and the feed mechanism 4 a slidably-mounted guide 8 is provided having two channels and which is mounted on one end of a bar member 9 of a control device consisting of a pneumatic cylinder 10. This cylinder 10 is supported by a bracket 11 that is fixed to the work surface 1. A guide bar 12, attached to and extending from the slidably-mounted guide, is adapted to move with said guide through an opening (not shown) provided in the bracket 11.

A movable companion guide 13, which also has two channels, forms an integral part of a plate 14 which includes a sleeve 15 having one end of an L-shaped support arm 16 assembled therein. The opposite end of this arm 16 assembles within a sleeve 17 (FIG. 3), and is selectively positionable therein by means of a screw 18. A sleeve 19 is attached to the sleeve 17 so as to extend perpendicular to the same and is adapted to slide along a bar 20 that is located longitudinally to the work surface 1 and to the right of the sewing axis 5.

The bar 20 is mounted in a support 21 which includes a gear wheel 22 around which a flexible member 23 extends and is attached at one end to the sleeve 19 with the opposite end to a known form of return device that is identified in FIG. 1 by numeral 24.

The movable companion guide 13 is caused to travel in a plane parallel with the bar 20 and is stabilized during its travel by means of a roller 25 which is supported by the plate 14 so as to engage the work surface 1.

Travel of the movable companion guide 13 is linked to the feeding of the material along the work surface, in that said guide is provided with a gripper device 26 (FIGS. 3 and 4) that is adapted to engage the workpiece. This gripper device 26 includes a pneumatic cylinder 27 that is pivotably connected at one end to a lever 28. Lever 28 is pivotably attached to the guide 13 as at 29 and includes a depending pin 30 at the end opposite its connection to the pneumatic cylinder 27.

The lever 28 when caused to pivot in a counterclockwise direction, as seen looking from the left in FIG. 3, lowers the pin 30 so as to pierce the layers of cloth in the channels of the guide 13 and will be more fully described hereinafter.

That end of the bar 20 most remote from the support 21 is disposed in close proximity with the sewing area and supports a plate element 31 thereon. The underside of the plate element 31 supports a microswitch 32 having an activator 33 which is adapted to be engaged by a shelf 34 that forms an integral part of the sleeve 19. This shelf 34 has a conical seat 35 mounted thereon and is adapted to receive a conical plug 36 that is attached to the actuating rod 37 of a pneumatic cylinder 38 that is mounted on the plate element 31 and will also be more fully described hereinafter.

A microswitch 39 is adjustably positioned adjacent the pathway of the sleeve 19 in such a manner that its activator 40 is adapted to be engaged by the sleeve itself.

The microswitch 39 is a sensing device which is operatively connected to the control for the slidably-mounted guide 8 and is activated by the movable companion guide 13.

Operation

Figure 2:
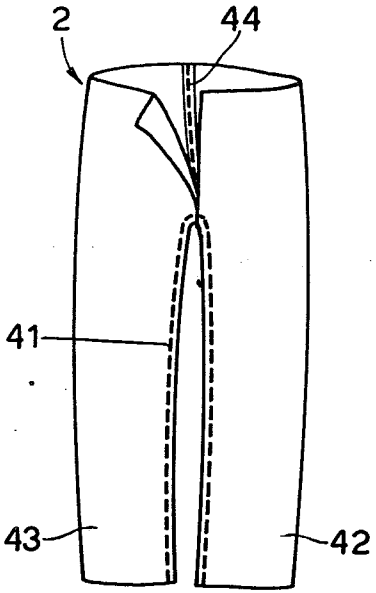
FIG. 2 is a view in front elevation showing a pair of trousers with an inside leg seam obtainable by means of the apparatus shown in FIG. 1.

The operation of the sewing unit will now be described with reference to the inside seam 41 (FIG. 2) for the legs 42 and 43 of the trousers 2 which essentially is the intended function of the unit.

The inside seam 41 intersects the crotch seam 33 that is normally interwoven and, consequently, is sewn on several superimposed layers.

The crotch seam 44 is unable to enter the channel 45 of the guide 8 because of its thickness.

A preliminary operation is that of clamping of the edge of the two superimposed layers that form the leg 43 by means of the gripper 6. These layers are inserted within the grooves 46 and 47 of the movable companion guide 13 with each layer in a separate channel so that the crotch seam 44 protrudes outwardly from the guide while the layers are held securely by the gripper device 26. This operation temporarily joins the trousers to the companion guide 13 which, at this time, serves as an intermediate coupling element so as to prevent the misalignment of the layers during the sewing of the leg 42. Lastly, the leg is inserted into the slidably mounted guide 8, with one layer being inserted into the groove numbered 45 (FIG. 3) the other into the groove numbered 48 and the free end remains in the sewing area so that the sewing operation may begin.

The sewing machine is started in the usual way and the feed device of the machine causes the trousers to move forwardly so as to form the seam 41.

Figure 3:
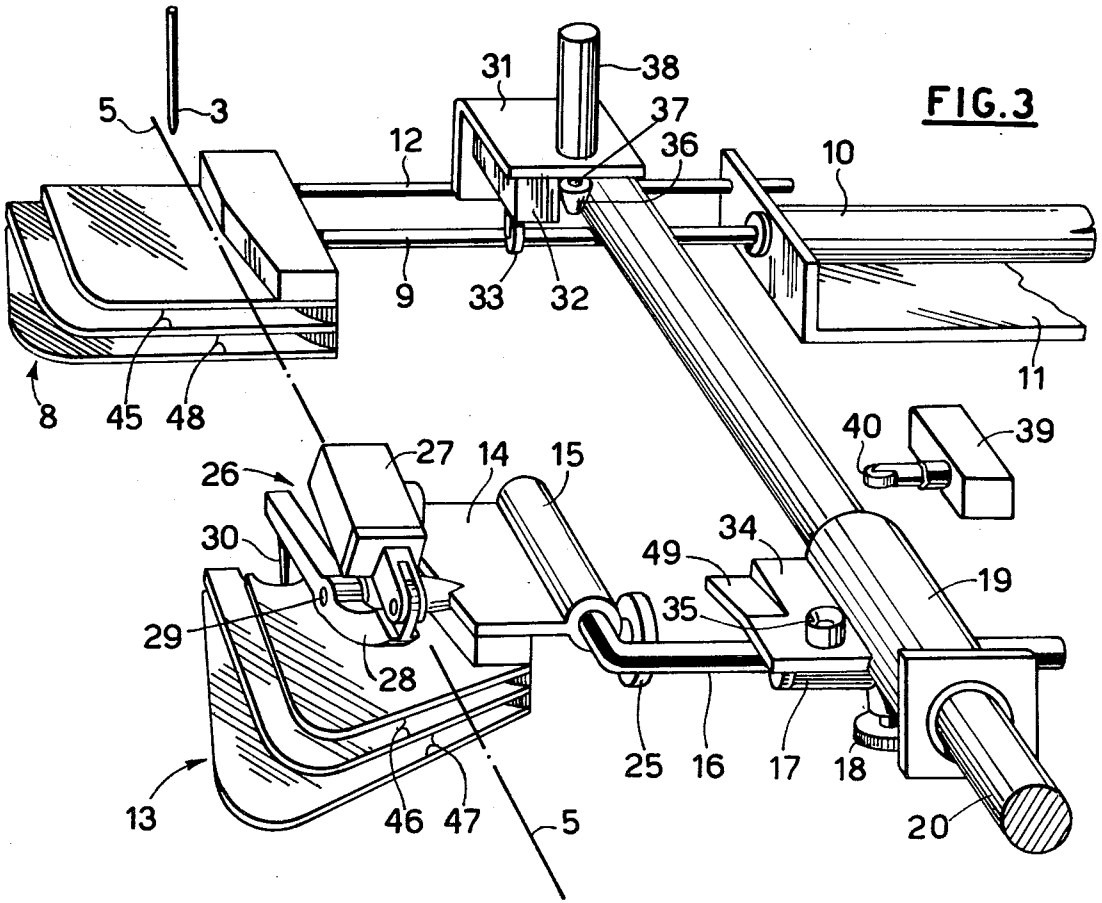
FIG. 3 is a perspective view of the sewing unit showing the location of the guides during the first phase of the stitching cycle.

During the initial seaming, the two edges of the leg 42 are guided by the slidably-mounted guide 8, which is in the sewing area in its operative position adjacent the needle 3 (FIGS. 1 and 3).

This position is maintained until the movable companion guide 13, which is drawn by the trousers from an initial position remote from the needle 3 arrives at a position adjacent the slidably-mounted guide 8. At this point, owing to the engagement of the sleeve 19 with the activator 40 of the microswitch 39 or the action of other similar devices such as a photoelectric cell or mercury switch, the slidably-mounted guide is moved to its rest position by the cylinder 10, which is controlled by the microswitch 39.

Figure 4:
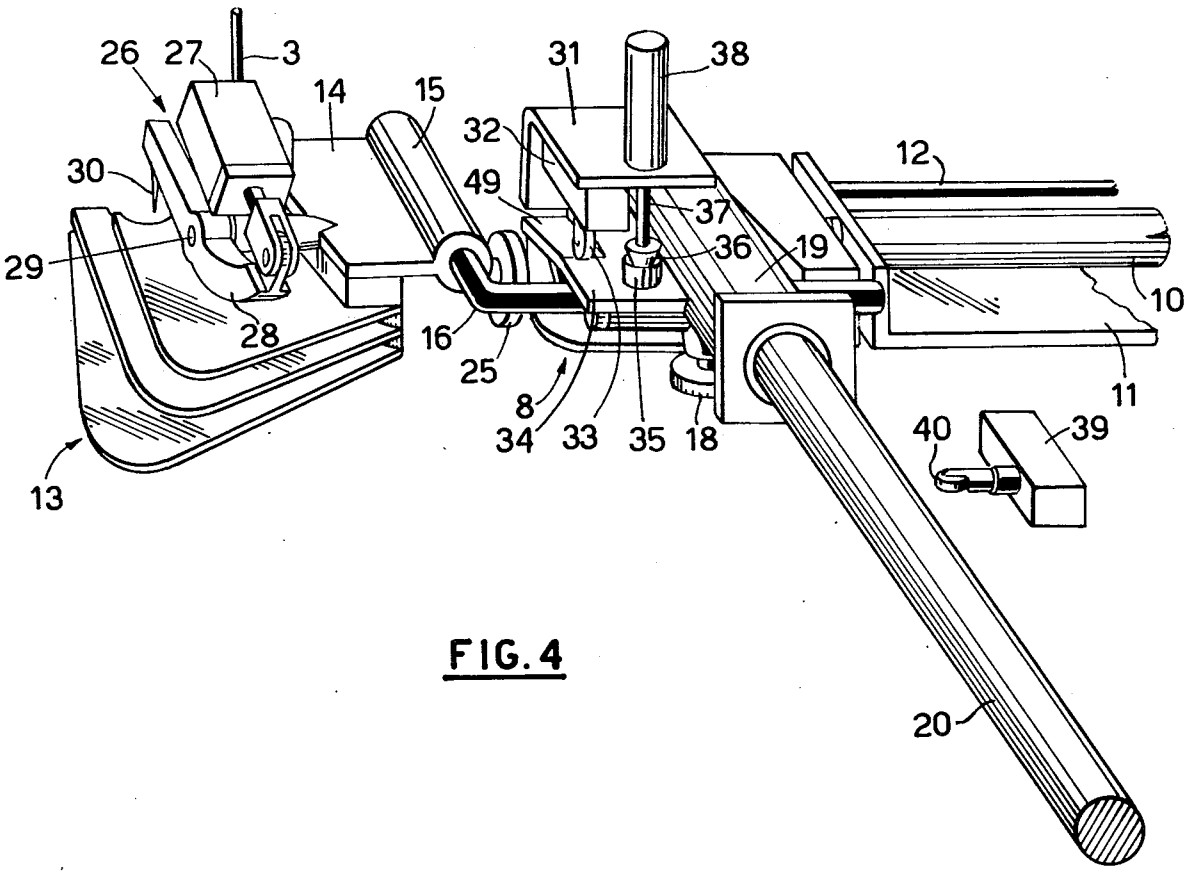
FIG. 4 is a view similar to FIG. 3 but showing the location of the guides near the end of the stitching cycle.

The slidably-mounted guide 8 is moved to its rest position as shown in FIG. 4 so that it will not interfere with the companion guide 13 as the latter approaches its limit of travel on the bar 20.

When the companion guide 13 reaches its limit of travel, the actuator 33 of the microswitch 32 is activated by a slanted surface 49 on the plate 34 and is effective in activating both pneumatic cylinders 27 and 38 simultaneously. The action of these cylinders causes the insertion of the conical plug 36 into the seat 35 and the release of the needle 30 from the trousers 2.

In this manner, the companion guide 13 is locked in operating position by the conical plug 36 and is effective in controlling the sewing of the leg 43 without impeding the movement of the material or the sewing of the small area defining the crotch seam 44 that is now located between said guide 13 and the needle 3. This is possible because the crotch seam never enters a channel in either guide because the slidably-mounted guide 8 as heretofor described is withdrawn in time to allow the companion guide 13 to travel its intended distance. At the end of the seaming cycle the gripper 6 is also automatically released by well known means not shown. When the sewing machine is automatically turned off, the cylinder 38 is deactivated, thereby leaving the companion guide 13 free to return to its initial position, by means of the device identified by numeral 24 in FIG. 1.

At the same time as the cylinder 38 is deactivated, the cylinder 10 returns the slidably-mounted guide 8 to its operating position adjacent the needle 3.

As can be understood from the above description, the unit is a major help in the joining of fabrics that are especially thin, in that the channels of the guides can be sized so as to permit passage of only a single layer of cloth, without taking into account possible thickening of certain areas, owing to intersecting seams, pockets, loops, or the like.

Although the present invention has been described in connection with a preferred embodiment, it is to be understood that modifications and variations may be resorted to without departing from the spirit and scope of the invention and the appended claims.

We claim:

1. An apparatus for guiding superimposed layers of cloth to be seamed having intersecting seams in a sewing unit of the type having a work surface with a sewing machine mounted thereon which includes a stitch forming needle and feed mechanism defining the sewing axis, said apparatus comprising:

(a) a slidable guide (8) mounted on the work surface for movement perpendicular to the sewing axis to and from an operating position adjacent the needle;

(b) a companion guide (13) slidably mounted on the work surface for movement parallel with the sewing axis to and from an operating position adjacent the needle;

(c) gripping means (26) pivotably attached to said companion guide (13) for engaging the cloth therein and moving said guide (13) toward the needle;

(d) actuating means defining a pneumatic cylinder (10) operatively connected to said slidable guide (8) for moving the latter between operative and inoperative positions;

(e) switch means (39) connected to said actuating means and disposed for activation by said companion guide (13) to move said slidable guide (8) to its inoperative position and permit said guide (13) to continue movement into operating position adjacent the needle.

2. The apparatus according to claim 1 wherein said companion guide (13) includes a pneumatic cylinder (27) for moving said gripping means (26) to and from engagement with the layers of cloth therein.

3. The apparatus according to claim 2 wherein said apparatus includes a pneumatic cylinder (38) for locking and releasing said companion guide (13) from an operating position adjacent the needle.

4. The apparatus according to claim 3 wherein said apparatus includes a switch member (32) operatively connected to said pneumatic cylinders (27) and (28) and disposed for activation by said companion guide (13) to effect simultaneous locking of said guide (13) in operating position adjacent the needle and release of the gripping means (26) from the layers of cloth.

* * * * *